United States Patent [19]

Tatsumi

[11] Patent Number: 4,644,884

[45] Date of Patent: Feb. 24, 1987

[54] THREAD CHAIN SEWING APPARATUS FOR USE IN OVEREDGE SEWING MACHINE

[75] Inventor: Eiji Tatsumi, Nara, Japan

[73] Assignee: Pegasus Sewing Maching Mfg. Co., Ltd., Japan

[21] Appl. No.: 633,978

[22] Filed: Jul. 24, 1984

[30] Foreign Application Priority Data

Jul. 28, 1983 [JP] Japan ..... 58-139780
Jul. 28, 1983 [JP] Japan ..... 58-139781

[51] Int. Cl.[4] ..... D05B 37/04; D05B 29/06; D05B 65/00; D05B 27/04

[52] U.S. Cl. ..... 112/130; 112/235; 112/288; 112/294; 112/304; 112/320; 112/DIG. 1

[58] Field of Search ..... 112/60, 61, 130, 235, 112/288, 294, 304, 320, DIG. 1

[56] References Cited

U.S. PATENT DOCUMENTS

| | | | |
|---|---|---|---|
| 3,100,469 | 8/1963 | Washburn | 112/269.1 |
| 3,310,014 | 3/1967 | Tucci | 112/230 X |
| 3,356,054 | 12/1967 | Southwell et al. | 112/287 |
| 3,465,702 | 9/1969 | Iizuka | 112/288 |
| 3,698,336 | 10/1972 | Launer | 112/288 X |
| 4,038,933 | 8/1977 | Marforio | 112/DIG. 1 X |
| 4,040,370 | 8/1977 | Marforio | 112/299 |
| 4,149,478 | 4/1979 | Sanvito et al. | 112/DIG. 1 X |
| 4,175,499 | 11/1979 | Navylt | 112/165 |
| 4,186,676 | 2/1980 | Villa et al. | 112/165 |
| 4,220,105 | 9/1980 | Palacino | 112/288 X |
| 4,250,824 | 2/1981 | Meier et al. | 112/269.1 |
| 4,328,758 | 5/1982 | Souza et al. | 112/235 X |
| 4,332,209 | 6/1982 | Gauch | 112/294 X |
| 4,338,873 | 7/1982 | Ueyama et al. | 112/262.1 |
| 4,356,782 | 11/1982 | Ueyama et al. | 112/197 |

FOREIGN PATENT DOCUMENTS

| | | | |
|---|---|---|---|
| 1258660 | 3/1961 | France | 112/235 |

OTHER PUBLICATIONS

Fed. Std. No. 751a, Jan. 25, 1965, Stitches, Seams, and Stitchings.

*Primary Examiner*—Wm. Carter Reynolds
*Attorney, Agent, or Firm*—Steele, Gould & Fried

[57] ABSTRACT

A thread chain sewing apparatus for use in overedge sewing machines has a thread chain catcher with a cutter for cutting a thread chain formed to extend from an end of a fabric and suctionally engaged against a suction opening. A presser foot having a guide groove for insertion of the thread chain is movable up and down, and a thread chain carrier is aligned with the thread chain catcher and has a suction nozzle for suctionally receiving the cut-off thread chain to carry it over the presser foot. An air blow tube running under the throat plate can be provided, an aperture thereof blowing the chain toward the suction opening. A thread chain presser mechanism has a holding plate movable up and down over the presser foot for pressing the thread chain into the guide groove of the presser foot. The apparatus operates such that the thread chain is sewn in while being positioned on the upper side of a next piece of fabric and without friction with the fabric, and is arranged such that an operator can watch as the thread chain is actually sewn in during the operation.

15 Claims, 31 Drawing Figures

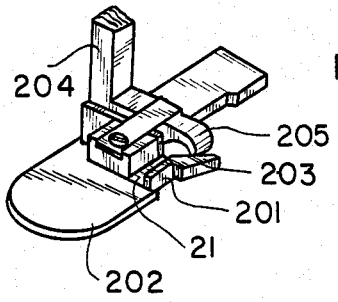
FIG. 14C
Fig.15
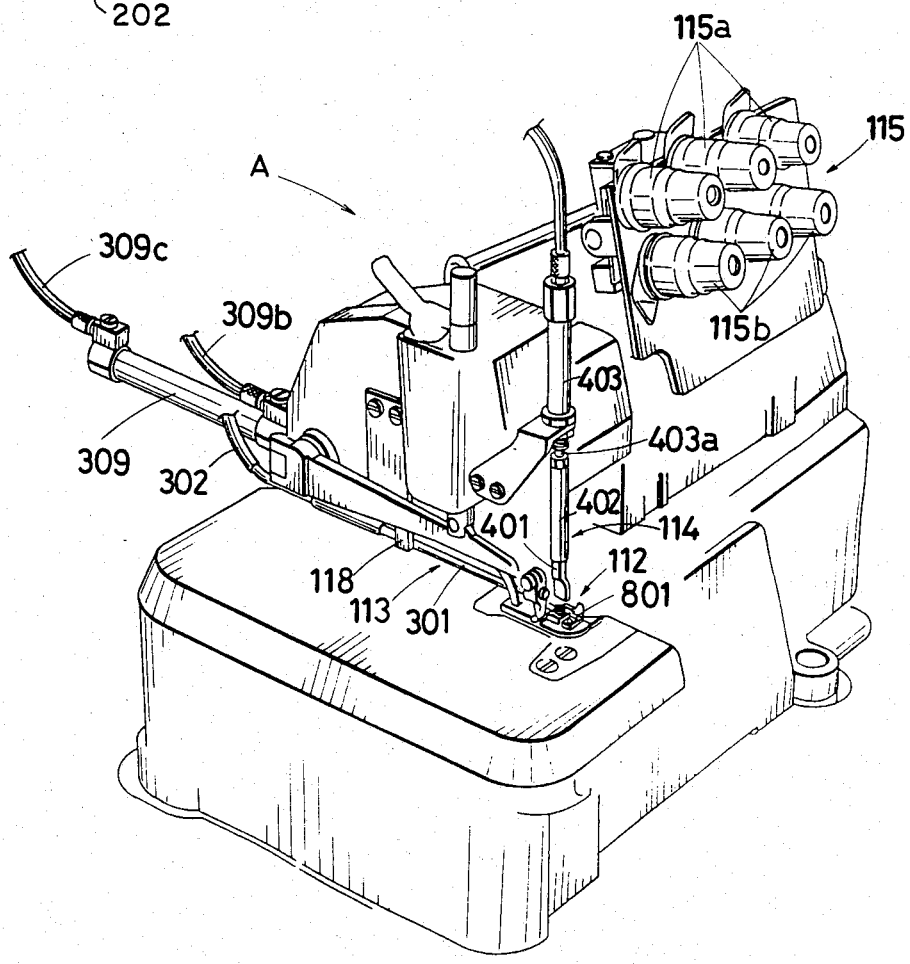

THREAD CHAIN SEWING APPARATUS FOR USE IN OVEREDGE SEWING MACHINE

BACKGROUND OF THE INVENTION

1. Field of the Invention

This invention relates to an improvement of a thread chain sewing apparatus having a back tuck function in which when overedging a fabric material, a cut off thread chain is automatically sewn in the first area of a seam of the fabric material, and more particularly to a thread chain sewing apparatus for use in an overedge sewing machine.

2. Prior Art

The thread chain sewing apparatus having a back tuck function to which this invention applies is generally used for consecutive overedging of a lower sleeve edge of some outer wear or the like, and the thread chain formed consecutively from the fabric end on which the overedging has been applied can be sewn in the first area of the seam of a new fabric without manual operation. The fundamental thought of the apparatus of this kind was already proposed in U.S. Pat. No. 4,220,105, and the apparatus according to said Patent has a feature in its positioning device for sewing the thread chain in the leading area of the seam of an oncoming fabric segment after cutting off the thread chain from the fabric segment on which overedging has completed.

In particular, said positioning device for cutting off the thread chain comprises a thread chain cutter equipped with a suction tube having a cutting knife supported near the free end of a finger of a presser and an orientation device operated by a draft tube, a grasping device equipped with a grasping blade and a suctional positioning tube, and a recessed groove extending on a throat plate between the finger of a presser of the throat plate and the grasping device. The thread chain is suctionally induced into the suction tube and after being cut off from the fabric on which the overedging has been completed, the thread chain is discharged to the grasping device by air blow through the draft tube, to be induced into the positioning tube of the grasping device. And at the same time, by moving the grasping blade up and down the thread chain is inserted into said groove so as to be positioned while being grasped by the grasping blade.

In the aspect of the actual operation of the foregoing conventional device, there exist several disadvantages as follows.

In the first place, when the thread chain is sewn in the fabric, it is inserted into the groove formed on the throat plate so as to be positioned on the lower side of a new fabric being moved over the throat plate. In this step, however, because of the construction or structure of the throat plate, said groove cannot be extended up to the needle location. Accordingly a problem of friction with the fabric exists, which affects retention of the thread chain and is not sufficiently overcome or solved, resulting in rather lower and limited efficiency of the sewing operation.

In the second place, since the thread chain is located on the lower side of the fabric, it is sewn blindly by the operator. Accordingly another problem exists in the difficulty of confirming whether the seam formation is adequately carried out or not during the operation, resulting sometimes in defective or non-conforming product having a skipped stitch or the like.

In the third place, since the thread chain is discharged by air blow of the draft tube after being caught by the suction tube and is received by the grasping device located relatively distant thereto, to be inserted into the groove of the throat plate, the position on which the thread chain is held is apt to be unstable, resulting in the difficulty of adequate positioning of the thread chain within the groove.

SUMMARY OF THE INVENTION

An object of this invention is therefore to provide a thread chain sewing apparatus equipped with automatic back tuck function, attachable to an overedge sewing machine, and enabling the thread chain to be positioned on the upper side of the fabric to be sewn therein.

Another object of this invention is to provide a thread chain sewing apparatus equipped with automatic back tuck function in which sewing the thread chain in the fabric is not characterized by excessive friction with the fabric, thus resulting in the formation of an adequate overedged seam on the fabric.

A further object of this invention is to provide a thread chain sewing apparatus equipped with automatic back tuck function in which the operator can watch the sewing condition of the thread chain during the operation.

A still further object of this invention is to provide a thread chain sewing apparatus equipped with an improved back tuck function in which a slit for a feed dog provided on the needle location side of the throat plate can be effectively operated and, for that purpose, the end of fabric comes exactly and rapidly to the needle location surface for carrying out the back tuck.

BRIEF DESCRIPTION OF THE DRAWINGS

Other features and advantages of this invention will become apparent in the course of the following description of preferred embodiments of this invention given in conjunction with the accompanying drawings wherein like parts are designated by reference numerals or characters throughout the same;

FIG. 11A and FIG. 11B are plan views respectively illustrating the throat plate when the thread chain is sewn in;

FIG. 18 is a perspective view illustrating another example of an overedge sewing machine to which this invention is applied;

FIG. 14C is a perspective view of the presser foot shown in FIGS. 11A and 11B.

FIG. 15 is a perspective view of a further embodiment of an overedge sewing machine to which the apparatus embodying this invention is applied;

DESCRIPTION OF THE PREFERRED EMBODIMENTS

Referring now to the accompanying drawings, several preferred embodiments of this invention are described in detail hereinafter. In the description hereunder the words "thread chain" and "chaining thread" have the same meaning, although they are separately used as the case may be.

Figure 1:
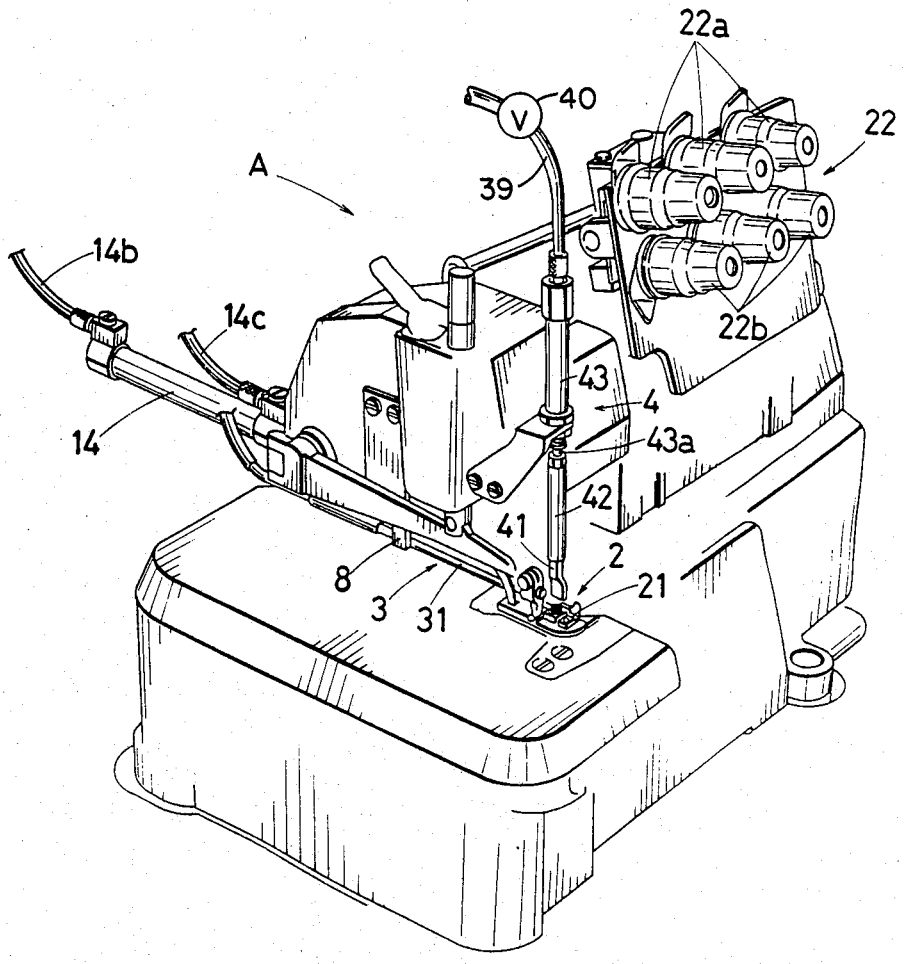
FIG. 1 is a perspective view illustrating an example of an overedge sewing machine to which an apparatus embodying this invention is applied.

FIG. 1 illustrates the perspective view of the overedge sewing machine to which this invention is applied. Shown are a presser foot 2, a thread chain carrier 3 and a thread chain presser mechanism 4 respectively, each forming an essential part of the apparatus embodying this invention. There is also shown in FIG. 1 a tension releasing device 22 equipped with sewing thread tension controllers 22*a*, 22*b*, which vary tension when the sewing machine is either in the state of "Chaining thread" or "Sewing". Other parts of said sewing machines A is almost the same as known sewing machine.

Figure 2A:
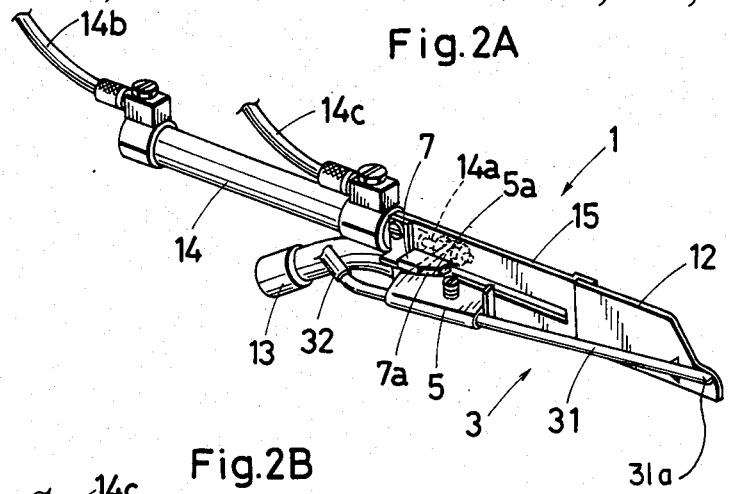
FIG. 2A and FIG. 2B are views respectively illustrating relative positions in the thread chain receiving position and the thread chain transfer position between the thread chain catcher and the thread chain carrier.
Figure 2B:
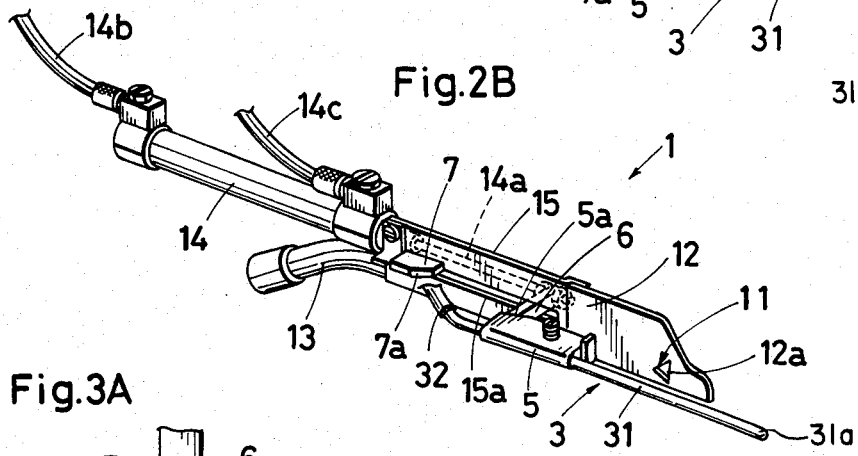

The thread chain catcher 1 and the thread chain carrier 3 are illustrated together with their operating procedure in FIG. 2A and FIG. 2B.

The thread chain catcher 1 comprises an air suction pipe 13 provided behind a suction area 12 having a suction opening 11 for suctionally engaging the thread chain 9. A cutter 12*a* is provided on the suction opening 11 for cutting off the thread chain suctionally induced into the opening 11 at a necessary or predetermined length by means of two cutting blades. The cutter 12*a* is a well-known type such as shown in U.S. Pat. Nos. 3,465,702, 4,220,105, etc. The two blades are driven by a drive unit which moves simultaneously with the main shaft of the sewing machine. In this embodiment the cutter is driven together with an upper knife holder 25, but the holder 25 moves to cut not a thread chain but an edge of the fabric. An upper knife 24 is secured to one end of the upper knife holder 25 (FIG. 7 and FIG. 8), which is movable up and down and cooperate with a lower rigid knife 26 to cut the edge of fabric.

Meanwhile, the thread chain carrier 3 arranged in parallel with the thread chain catcher 1 has a suction nozzle 31 connected with an air source (not illustrated) through a suction pipe 32 to receive the thread chain 9 when cut off by the thread chain catcher 1 and to transfer or carry the same above the presser foot 2. Said suction nozzle 31 is fixed to one end of a working rod 14*a* of an air cylinder 14 provided behind the thread chain catcher 1 through an L-shaped connecting bracket 6 described hereunder.

Since said connecting bracket 6 is securely connected to one end of the working rod 14*a* of the air cylinder 14 in such manner as to project from a guide slit 15*a* provided by the side of an intermediate bracket 15 and a holder 5 is fixed to the connecting bracket 6, when the working rod 14*a* makes a reciprocating movement, the suction nozzle 31 comes to move from a thread chain receiving position (FIG. 2A) to a thread chain transfer position (FIG. 2B).

Said air cylinder 14 serves as a drive source of the thread chain carrier 3 and is provided with an air feed pipe 14*b* as well as an air discharging pipe 14*c* for the movement of the working rod 14*a* forward and backward, said each pipe being interposed by a well known type speed controller (not illustrated). When the air is supplied to the air feed pipe 14*b*, the working rod 14*a* moves forward, and when the air is supplied to the air discharging pipe 14*c*, the working rod 14*a* moves backward.

When the suction nozzle 31 is located at the thread chain receiving position, a tapered portion 5*a* formed on the back side of the holder 5 makes contact with an inclined face 7*a* of an inclined cam 7, pressing the distal end of suction nozzle 31 against cutter 12*a* in the area of suction opening 11. When the working rod 14*a* extends to the thread chain transfer position, the suction nozzle 31 returns to the position in parallel with the thread chain catcher 1.

FIGS. 3A to 5 illustrate the relation between the connecting bracket 6 and the holder 5, both enabling or assisting the suctional operation of the suction nozzle 31 in said thread chain carrier 3.

Said holder 5 is pivoted on the connecting bracket 6 in such manner that a screw 52 with a spring 51 mounted thereon is inserted into a hole 5*b* for screw-thread insertion into the connecting bracket 6.

A spring 62 received in a spring receiving hole 6*a* provided by the side of the connecting bracket 6, presses against the suction nozzle 31 so that the suction nozzle 31 is always urged clockwise (indicated by arrow in FIG. 3A), i.e. in the direction where the end of the nozzle 31 separates from the thread chain catcher 1.

Meanwhile, said inclined cam 7 is fixed to the intermediate bracket 15 on the side of bracket 15 facing toward the holder 5, said inclined cam having the inclined face 7*a* formed on the notched portion of the front side thereof. And the tapered portion 5*a* is formed on the back side of the holder 5 corresponding to said inclined face 7*a*.

Figure 3A:
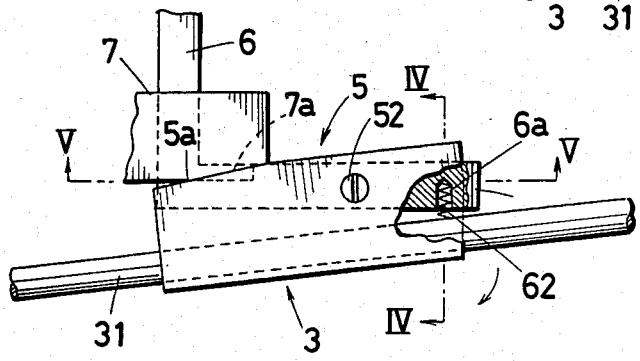
FIG. 3A and FIG. 3B are partial plan views respectively illustrating relative positions in the thread chain receiving position and the thread chain transfer position between the holder and the inclined cam.
Figure 3B:
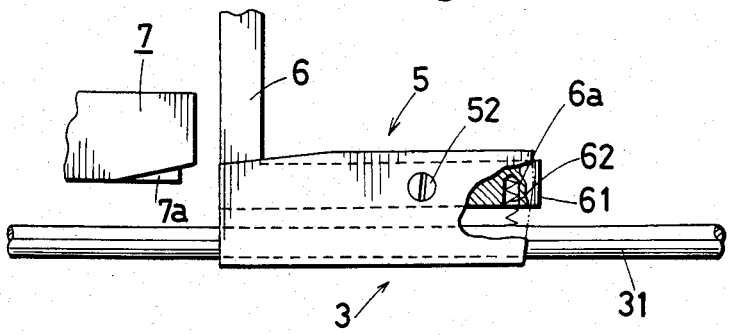
Figure 4:
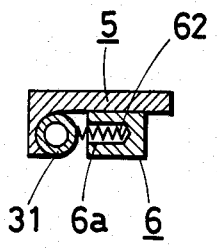
FIG. 4 is a sectional view taken along line IV—IV of FIG. 3A.
Figure 5:
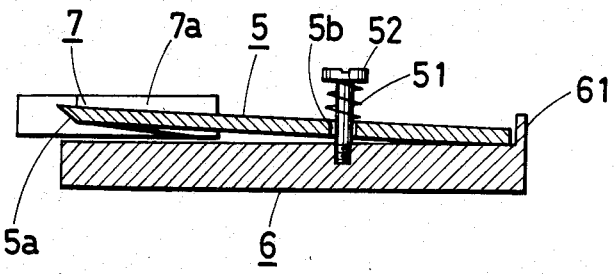
FIG. 5 is a sectional view taken along line V—V of FIG. 3A.

By the foregoing construction, when the suction nozzle 31 moves back to the thread chain catching position, the tapered portion 5*a* of the holder 5 comes in contact with the inclined face 7*a* of the inclined cam 7 so that the suction nozzle 31 turns counter-clockwise as illustrated in FIG. 3A. And when the suction nozzle 31 further moves back and the tapered portion 5*a* of the holder 5 comes to be placed on the inclined face 7*a* of the cam 7 as illustrated in FIG. 5, the suction nozzle 31, which faces downwardly, comes near to the suction opening 11 of the thread chain catcher 1, thereby the thread chain or chaining thread 9 being easily received in nozzle 31 from the thread chain catcher 1.

In this connection, a projection end 61 of the connecting bracket 6 serves as a stopper for regulating the returning position of the suction nozzle 31 to which the resiliency of the spring 62 is applied, and the holder 5 is in the state of contact with the stopper at the thread chain transfer position.

A guide plate 8 is also provided for preventing the thread chain carrier 3 from being vibrated during the reciprocating movement thereof.

Said presser foot 2 and the thread chain presser mechanism 4 are illustrated in FIGS. 1, 8, 9 and 10. Namely, the presser foot 2 has a guide groove 21 provided on the side near to needle 10 for the insertion of the thread chain 9 therein, while the thread chain presser mechanism 4 has a holding plate 41 with its shape corresponding to said guide groove 21.

As illustrated in FIGS. 11A, 11B, 14A, 14B and 14C, the presser foot 2 comprises a presser latch 201 provided with the guide groove 21 for the insertion of the thread chain 9, and a base plate 202 occupying the greater part of the presser foot 2. Said presser latch 201 is to press the fabric 18 placed on the upper side of a throat plate latch 17*a* (illustrated in FIG. 11A) provided on the throat plate 17, and is provided with a projection piece 203 standing out from the guide groove 21 and extending forward. A presser leg 204 is to prevent the thread chain 9 inserted in the guide groove 21 from getting out, using a guide latch 205 formed in front of the guide groove 21.

As illustrated in FIG. 1, the thread chain presser mechanism 4 makes it possible for a working cylinder 42 including a spring (not illustrated) as well as a working rod 43*a* of an air cylinder 43 fixed to the end of the working cylinder 42 to move up and down by urging an electromagnetic valve to control compressed air flow through an air feed pipe 39. And since said holding plate 41 receives the resiliency of the spring (not illustrated) in the working cylinder 42, the pressure applied to the thread chain is adjustable. Thus, according to the foregoing construction, when the thread chain 9 is carried above the presser foot 2 by means of the thread chain carrier 3, the thread chain presser mechanism 4 starts to lower the holding plate 41. The transferred thread chain 9 is then exactly inserted into the guide groove 21 being pressed by the cooperative operation between the thread chain carrier 3 and the holding plate 41.

The thread chain presser mechanism 4, together with the thread chain catcher 1 and the thread chain carrier 3, is intended to be subject to sequential control in accordance with this embodiment. Furthermore, it may be also operated manually or connected with a foot control (not illustrated) for the movement of the presser foot 2 up and down.

Figure 6:
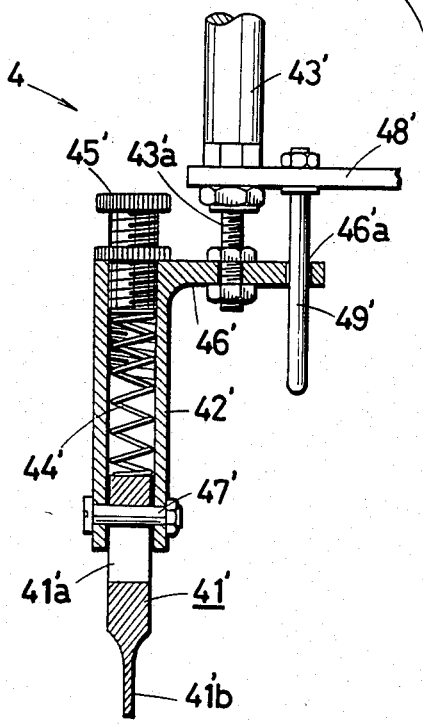
FIG. 6 is a longitudinal section view of the essential part of another embodiment of the thread chain presser mechanism.

It is further possible to construct the thread chain presser mechanism 4 according to an alternative embodiment as illustrated in FIG. 6. Namely, in FIG. 6 the holding plate 41' is provided with a slot 41'*a* on the upper part thereof for the regulation of cushion stroke and has a holding projection piece 41'*b* on the lower side corresponding to the shape of the guide groove of the presser foot 2. Plate 41' is secured to one end of the working cylinder 42' by inserting a fitting bolt 47' through into the slot so that the holding plate 41' does not get out of the end of the working cylinder 42'.

A spring 44' held in the working cylinder 42' presses against the head of the holding plate 41', and the pressure is adjustable by controlling the position of an adjusting screw 45' screwed into the upper part of the cylinder 42'.

A support arm 46' extends from the upper end of the working cylinder 42' and is fixed to a working rod 43'*a* of an air cylinder 43'. The movement of the working rod up and down is performed by charging and discharging the air to and from the air cylinder 43'. The air feed pipe to cylinder 43' may include an air pressure regulator.

In this connection, a through hole 46'*a* is provided on the support arm 46' so that a guide bar 49' is inserted through the hole 46'*a* to be supported there. Said guide bar 49' is to prevent the working cylinder 42' from vibrating during the movement up and down of the working rod 43'*a* of the air cylinder 43'. This embodiment makes it easy to adjust the pressure of holding plate 41' and smoothly to insert the thread chain in the groove.

The thread chain presser mechanism 4 is not restricted to the foregoing embodiment, and in FIG. 1 the pressing force applied to the thread chain from the holding plate is made adjustable by providing an air feed pipe 39 of the air cylinder 43 with a pressure regulator 40 (the regulator is a well-known type).

Although a well-known series of controls to be carried out for the back tuck operation using the overedge sewing machine to which this invention is applied is intended to be performed by a sequencer operative to actuate electromagnetic valves, solenoid or the like, there is provided in the foregoing embodiment a well-known home position stop device by which an upper looper 16 stops at the right side of the needle 10 when operating the thread chain carrier 3 so that the suction nozzle 31 is prevented from collision with the upper looper 16 during the operation thereof.

When the suction nozzle 31 of the thread chain carrier 3 is staying above the presser foot 2, it is also preferred to provide a safety device for forcibly stopping the operation of the sewing machine when necessary. Appropriate electromagnetic and/or pneumatic clutch means are known to those skilled in the art.

Figure 7:
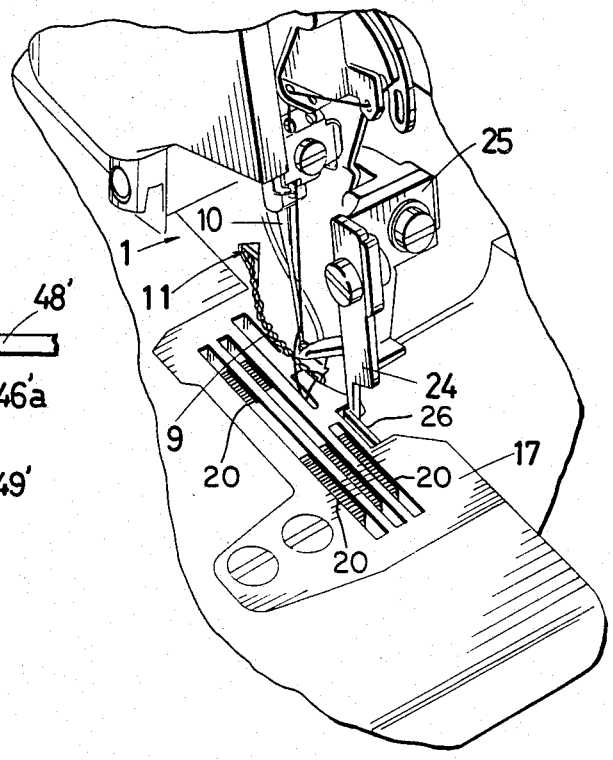
FIG. 7, FIG. 8, FIG. 9 and FIG. 10 are views respectively illustrating the positioning process of the thread chain in accordance with the apparatus embodying this invention.
Figure 8:
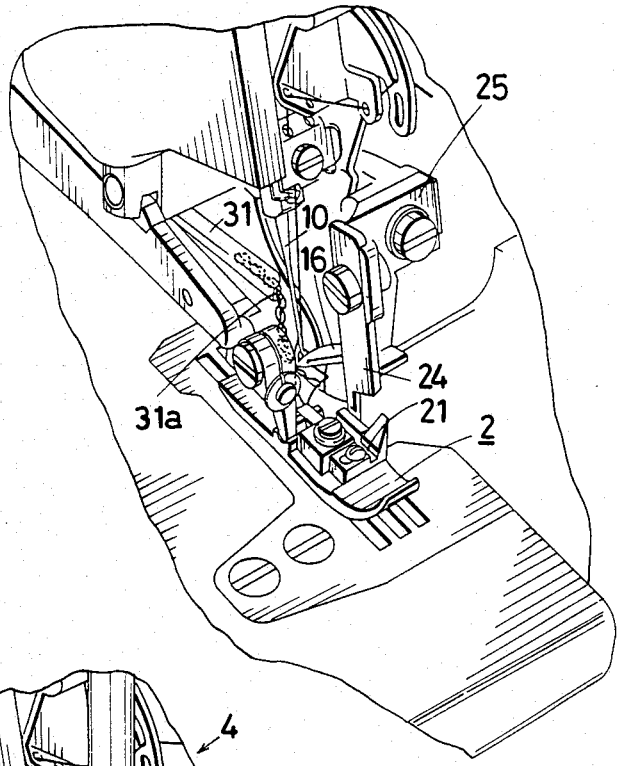
Figure 9:
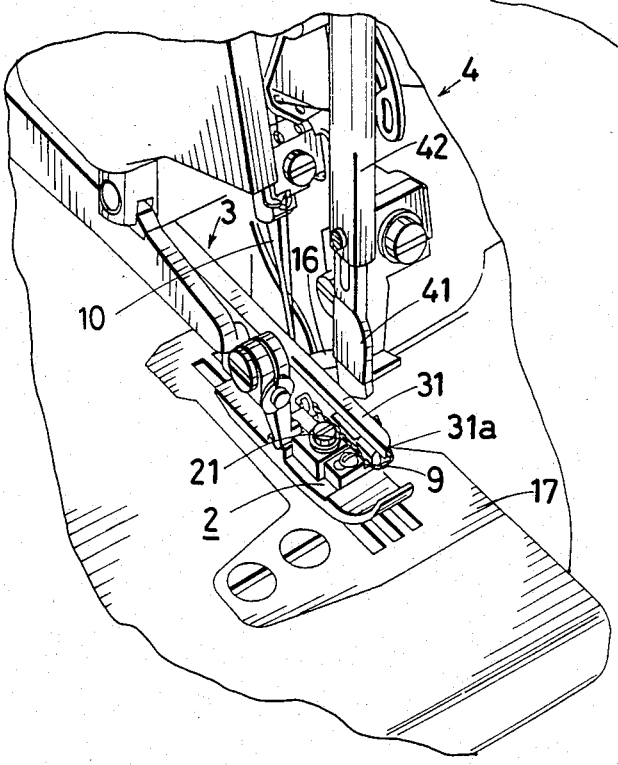

Referring now to FIGS. 7 to 9, the operating procedure of control necessary for the overedge sewing machine to which this invention applied to be carried out for automatic back tuck operation is described in detail hereunder.

When an end of the fabric comes near to the needle location and the fabric detection sensor (not illustrated) detects that the fabric has been exhausted, a stitch counter (not illustrated) starts counting.

When a predetermined stitch number, and therefore chain length, has been counted by the stitch counter, the stitch balancing thread tension of the tension releasing device 22 is changed from "Sewing" to "Chaining thread", and the sewing machine continues running to form the thread chain 9.

Then, a needle positioner which is well known and used in conventional automatic sewing machines, is started to operate the home position stop device. The needle 10 is lifted to the upper face of the throat plate to keep the upper looper 16 at the position a little deviated to the right from the needle 10, and thus the operation of the sewing machine is stopped.

When the operation of the sewing machine has stopped, the thread chain 9 is positioned according to the following procedure.

Namely, the thread chain catcher 1 stops its suction, and a part of the thread chain 9 suctionally induced into the suction opening 11 is cut off by the cutter 12*a* so that the necessary sized thread chain 9 is secured to be sewn in the first area of the seam of next fabric. (FIG. 7).

When the suction by the thread chain catcher 1 has stopped, the suction by the suction nozzle 31 of the thread chain carrier 3 is started, and the nozzle 31 comes to receive the thread chain 9 from the thread chain catcher 1 carrying the same into the suction port 31*a*. At this moment, the thread chain catcher 1 and the thread chain carrier 3 are situated at the thread chain receiving position as illustrated in FIG. 2A.

Then the suction nozzle 31 moves forward while keeping or holding the thread chain 9 in the suction port 31*a* and comes to the thread chain transfer position as illustrated FIG. 2B (FIG. 8 and FIG. 9).

Figure 10:
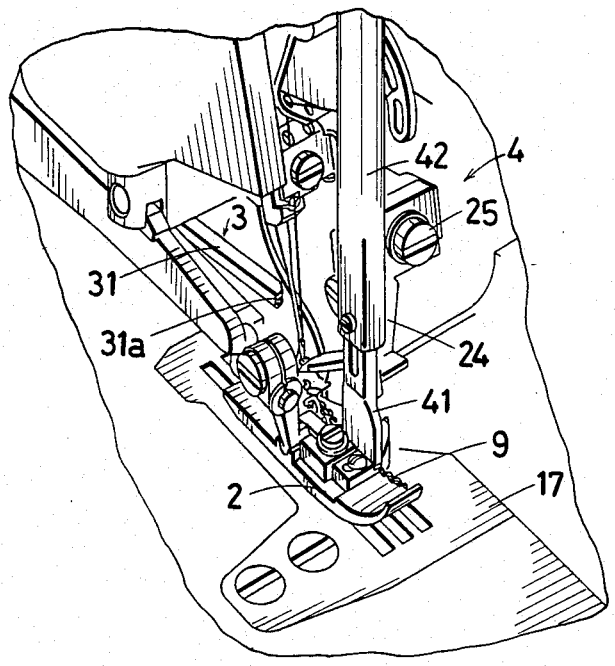

The thread chain 9 is then laid over the guide groove 21 of the presser foot 2, and when the suction nozzle 31 comes further to the predetermined position above the presser foot 2, the holding plate 41 above the presser foot 2 comes down to press the thread chain 9 into the guide groove 21 of the presser foot 2 (FIG. 10). For a while after said insertion, the thread chain 9 is kept pressed in the guide groove 21, and the pressing force is adjustable as above-described.

Figure 11A:
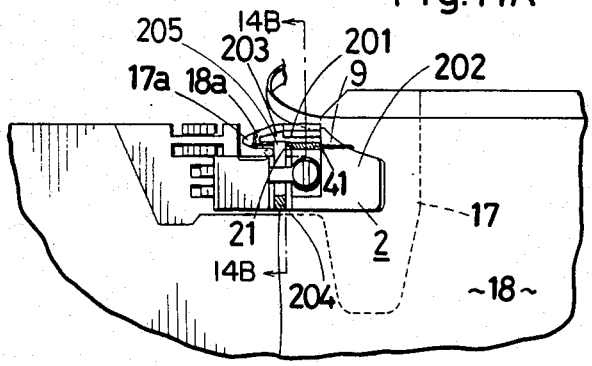

Thus, after the suction by the nozzle 31 has stopped, the thread chain carrier 3 returns to the thread chain receiving position illustrated in FIG. 2A, and when the holding plate 41 comes up together with the presser foot 2 while pressing the thread chain 9 in the guide groove 21 of the presser foot 2 to insert the fabric under the presser foot 2, the presser foot 2 is lowered or comes down again to put the fabric between the throat plate 17 and the presser foot 2 (FIG. 11A).

Figure 11B:
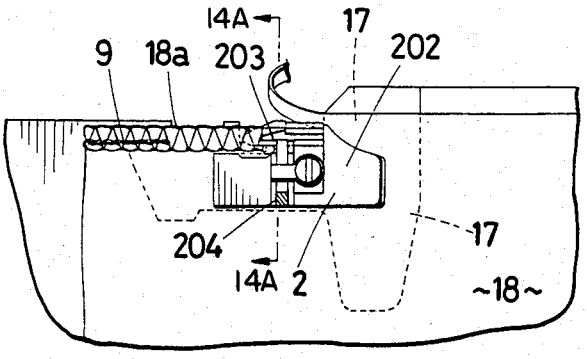
Figure 12:
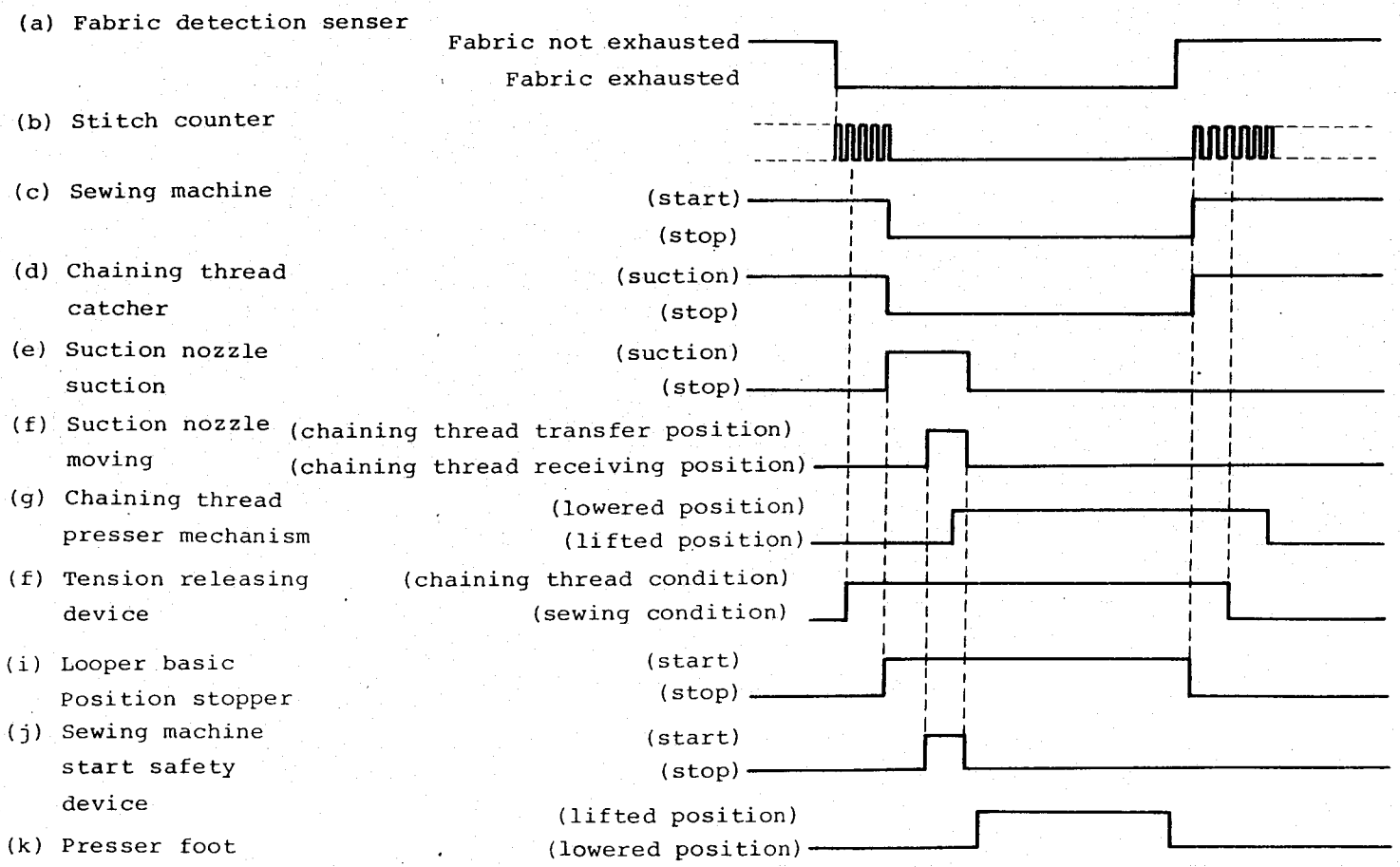
FIG. 12 is a timing chart illustrating a control sequence of each part of the apparatus when the back tuck of the thread chain is carried out by the apparatus embodying this invention.

Then when putting the sewing machine in the operation, the suction opening 11 of the thread chain catcher 1 again starts the suction, and after the stitch number is counted by the stitch counter, having started the count based on the detection signal of the fabric end detection senser, the stitch balancing thread tension of the tension releasing device is changed from "Chaining thread" to "Sewing". When reaching to the predetermined count number, the holding plate 41 comes up, thereby the thread chain 9 being sewn in the new seam (FIG. 11B).

Thus, the thread chain 9 consecutively formed after the overedging operation is inserted into the guide groove 21 of the presser foot 2 to be positioned, and when the seam 18*a* of the new fabric 18 is formed, the thread chain 9 is sewn in the upper side of the fabric 18, which procedure is repeated for fabric pieces one after another.

FIGS. 12(a) to (k) shows the controlling procedure of each part in this embodiment of this invention.

Figure 13:
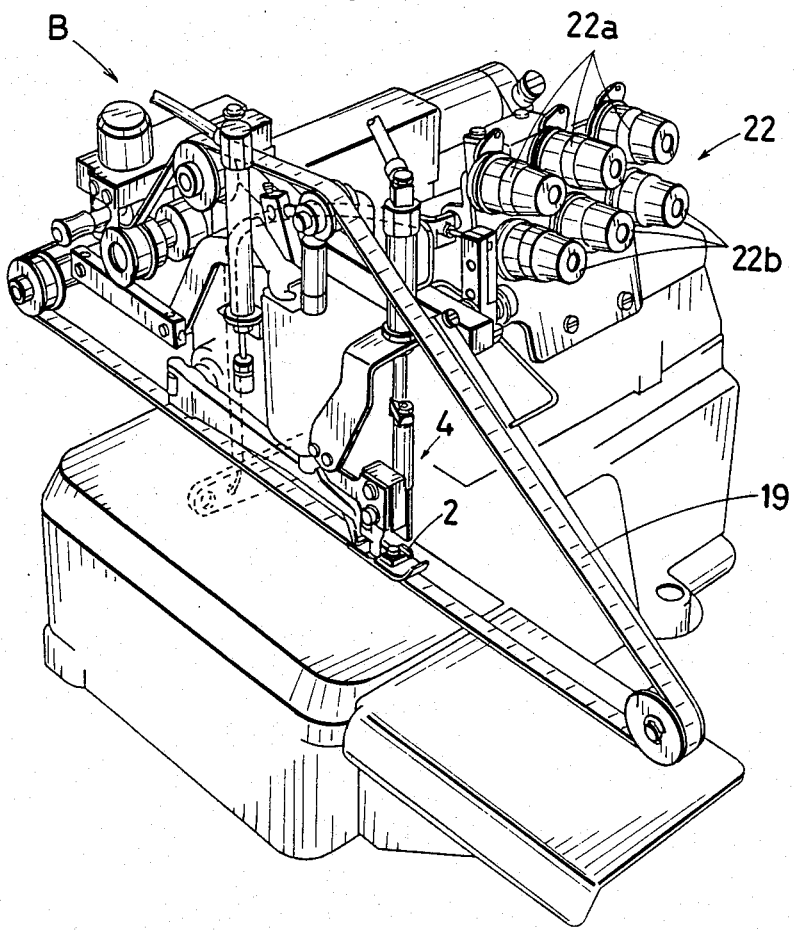
Figure 14A:
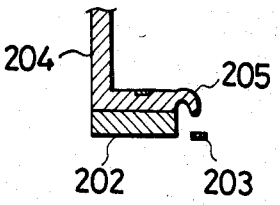
FIG. 14A and FIG. 14B are sectional views respectively taken along line 14A—14A of FIG. 11B and line 14B—14B of FIG. 11A.
Figure 14B:
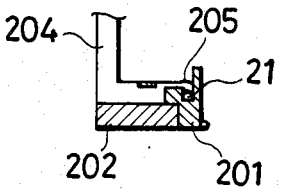

It is to be noted that this invention is applicable not only to the known overedge sewing machine like the machine equipped with the feed dog 20 on the throat plate thereof as illustrated in FIGS. 1 and 7, but also to an overedge sewing machine B equipped with an endless conveyer belt 19 as illustrated in FIG. 13.

Referring then to the accompanying drawings, a further embodiment is described in detail hereinafter.

FIG. 15 illustrates a perspective view of the overedge sewing machine to which a further apparatus embodying this invention is applied. The thread chain catcher, the presser foot 112, the thread chain carrier 113 and, the thread chain presser mechanism 114 are each shown respectively. Also shown in FIG. 15 are the tension releasing device 115 equipped with sewing thread tension controllers 115*a*. 115*b* to be used when the sewing machine is either in the state of stitch balancing thread tension for "Chaining thread" or "Sewing". Other parts of said sewing machine A are almost the same as known machines.

Figure 16:
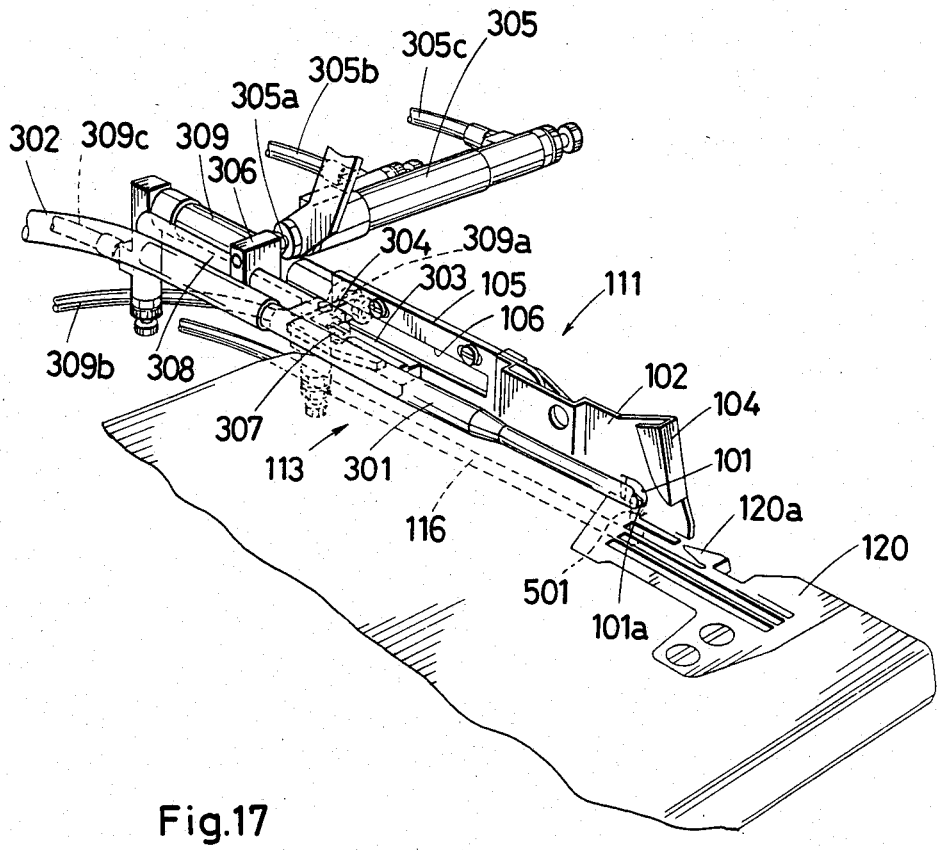
FIG. 16 is a view illustrating in detail the thread chain catcher and the thread chain carrier of FIG. 15.
Figure 17:
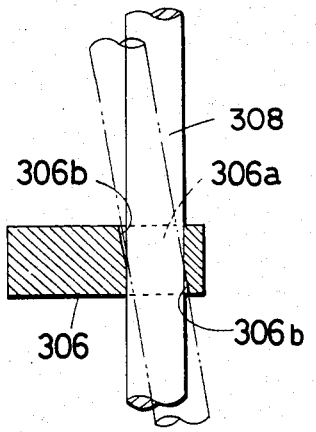
FIG. 17 is a view illustrating a relation between the guide bar and the movable member in FIG. 16.

The thread chain catcher 111 and the thread chain carrier 113 are illustrated together with their operating procedure in FIG. 16 to FIG. 18.

The thread chain catcher 111 has an air suction opening 101 provided behind the suction area 102 for the suction engagement of the thread chain 119. The cutter 101*a* is provided on the suction opening 101 for cutting off the thread chain 119 when suctionally induced into the suction opening 101 at a necessary or predetermined length. The cutter 101*a* has two cutting blades and is driven by a drive unit which is moving together with an upper knife holder 71. An upper knife 117 (FIG. 19) is secured to one end of the upper knife holder 71 (FIG. 19) which moves up and down. The two cutting blades operate like scissors to cut the thread chain and do not appear precisely behind the suction area 102. The upper knife cooperates with a lower rigid knife (not shown) alongside the throat plate to cut an edge of the fabric.

A hood 104 formed at the end of the suction area 102 is to avoid loss of the suctional induction of the thread chain toward suction nozzle 301 caused by oscillation of the thread chain 119, making use of a compressed air puff blown out of a blowing aperture 501 of an air blow pipe 116 described hereunder. Although, in the illustrated example, the hood 104 is formed at the end of the suction area 102 of the thread chain catcher 111, it may be also formed on the side of the main body of the sewing machine.

Said air blow pipe 116 ends at an aperture 501 oriented to blow air upwards towards said suction opening 101 of the thread chain catcher 111. Pipe 116 is arranged under the throat plate 120 as shown in phantom in FIGS. 18A–18C.

Meanwhile, the thread chain carrier 113, arranged in parallel with the thread chain catcher 111, has the suction nozzle 301 connected with the air source (not illustrated) through the suction pipe 302 in order to receive the thread chain 119, now cut off by the thread chain catcher 111, and to carry or transfer the thread chain 119 above the presser foot 112. Said suction nozzle 301 is fixed to one end of the working rod 309*a* of the air cylinder 309 provided behind the thread chain catcher 111 through a fitting 303 and a L-shaped connecting bracket 304.

As said connecting bracket 304 is secured to one end of the working rod 309*a* of the air cylinder 309 in such manner as to project or stand out from the guide slit 106 provided by the side of the intermediate bracket 105, and said fitting 303 is also fixed to the connecting bracket 304, when the working rod 309*a* makes a reciprocating movement, the suction nozzle 301 comes to move from the thread chain receiving position (FIG. 18A) to the thread chain transfer position (FIG. 18C) described hereunder.

Said fitting 303 to which the suction nozzle 301 is fixed is rotatably connected to the bracket 304 by the set screw 307, and a guide bar 308 is fixed to the rear end of the fitting 303. Said guide bar 308 is further supported in an insertion hole through the movable member 306 fixed to the working rod 305*a* of another air cylinder 305 in order to make a smooth longitudinal movement of the suction nozzle 301. Said insertion through hole is provided with inclined faces 306*b*, 306*b* on the inner face of the hole 306*a* along the moving direction of the suction nozzle 301 as illustrated FIG. 17.

Said air cylinder 309 serves as a drive source of the suction nozzle 301 of the thread chain carrier 113 and is provided with an air feed pipe 309*b* as well as an air discharging pipe 309*c* for the movement of the working rod 309*a* forward and backward, each said pipe being interposed by a flow rate controller. And when the air is supplied to the air feed pipe 309*b*, the working rod 309*a* moves backward, and when the air is supplied to the air discharging pipe 309*c*, the working rod 309*a* moves forward.

Figure 18A:
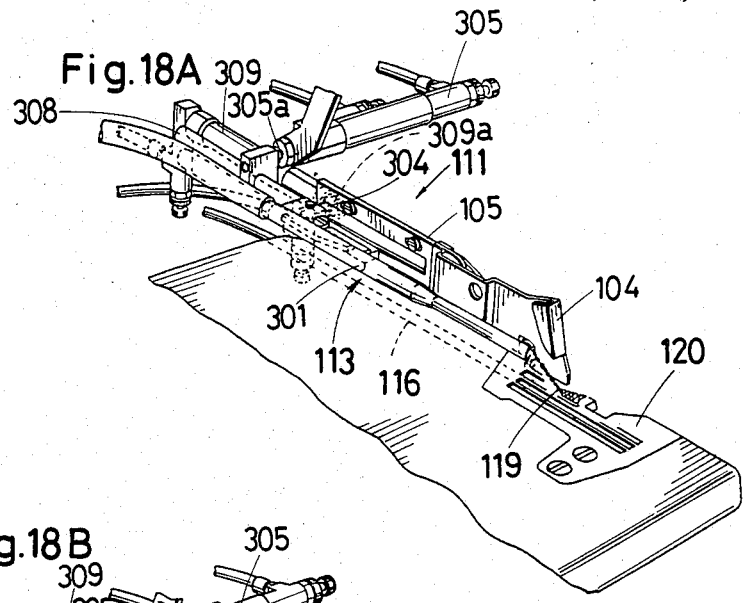
FIG. 18A, FIG. 18B and FIG. 18C are routing diagrams illustrating relative positions during the process of receiving a thread chain and the transfer thereof between the thread chain catcher and the thread chain carrier in FIG. 16.
Figure 18B:
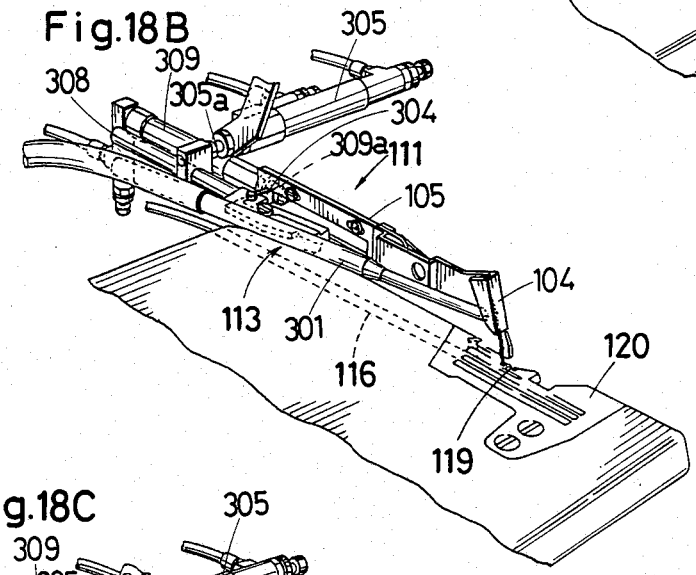

The air cylinder 305 also has an air feed pipe 305*b* as well as an air discharging pipe 305*c*, and when the suction nozzle 301 receives the thread chain 119 from the thread chain catcher 111, the working rod 305*a* moves longitudinally as illustrated in FIG. 18B so that the aperture of the suction nozzle 301 comes near to the suction opening 101 of the thread chain catcher 111.

By the foregoing construction, when the suction nozzle 301 moves to the thread chain catching position and the working rod 305*a* of the air cylinder 305 moves forward, since the nozzle 301 comes near to the suction opening 101 of the thread chain catcher 111 as illustrated in FIG. 18B, the thread chain 119 can be easily and smoothly received from the thread chain catcher 111. There is also shown in FIG. 15 a guide plate 118 for preventing the nozzle 301 of the carrier 113 from being vibrated during the reciprocating movement thereof.

Figure 20A:
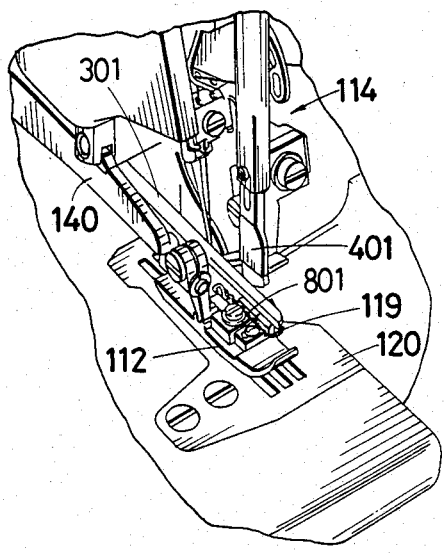
FIG. 20A and FIG. 20B are routing diagrams illustrating the relative positions of the thread chain presser mechanism and the presser foot when the thread chain is inserted into the guide groove of the presser foot of FIG. 15.
Figure 20B:
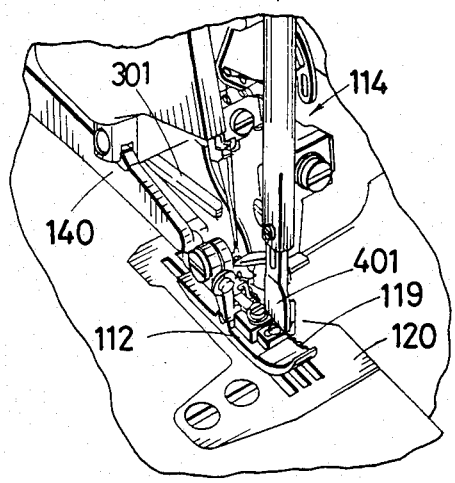
Figure 21:
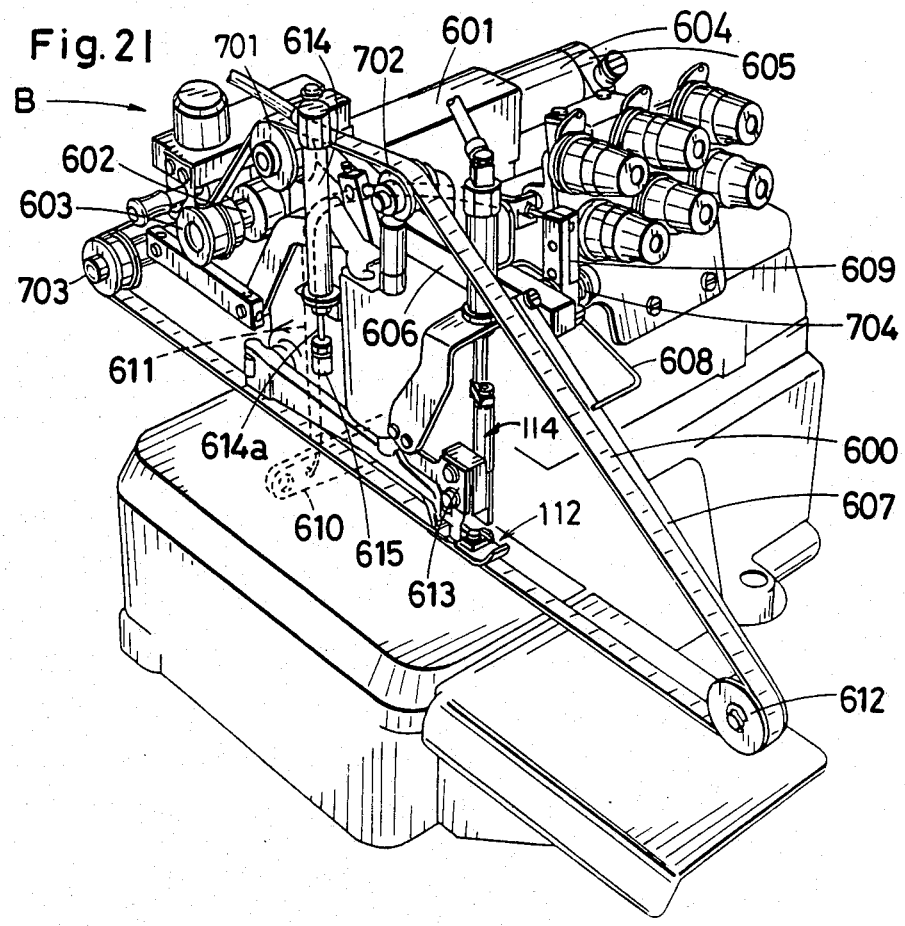
FIG. 21 is a perspective view illustrating a still further example of the overedge sewing machine to which the apparatus embodying this invention is applied.

Furthermore, the apparatus embodying this invention is applicable to an overedge sewing machine as illustrated in FIG. 21. Namely, in FIG. 21, there is shown a well-known overedge sewing machine equipped with an endless conveyer belt 600. The machine is provided with the thead chain catcher 111, the presser foot 112, the thread chain carrier 113 and the thread chain presser mechanism 114, these elements being shown in FIGS. 15–20 and mentioned hereinabove. The following description is set forth relating to this embodiment as concerns those elements.

Referring to FIG. 21, a belt drive pulley 603 is fixed to one end of a belt drive shaft 602 supported on a bed 601 fixed to a main body B of the sewing machine. And a oneway clutch 604 combined with a crank 605 is mounted on another end of said belt drive shaft 602. The crank 605 connecting with a main shaft (not illustrated) of the sewing machine produces an oscillating movement by the revolution of the main shaft. Said oscillating movement of the crank 605 is transmitted to the belt drive shaft 602 as oneway intermittent rotation by means of the clutch 604, which is free to rotate in one direction only.

The rotation of the belt drive shaft 602 is adjustable by controlling the oscillation of the crank 605.

A frame 606 fixed to the main body of the sewing machine is provided with pulleys 701, 702, 703 rotatably supported on their respective positions. A working lever 607 is rotatably supported on one end of said frame 606 and is urged clockwise by a spring 608. An interlocking lever 609 is fixed to a shaft 704 supporting said working lever 607 on the frame 606, and one end of said interlocking lever 609 is connected a lifting lever 610 of the presser foot 112.

Another pulley 612 is rotatably supported on another end of the working lever 607, and an endless conveyer belt 600 comes in contact with the under side of the presser foot 112 and carries the fabric synchronously with the feed dog (not illustrated) of the sewing machine by the intermittent rotation of the belt drive pulley 603.

There are further shown in FIG. 21 a sensor 613 for detecting the end of the fabric, a fabric presser air cylinder 614 equipped with a fabric pressing portion 615 on the end of the working rod 614*a* thereof. When the thread chain 119 formed consecutively from the end of the fabric is caught and cut off by the thread chain catcher 111 to be transferred to the thread chain carrier 113, said air cylinder 614 temporarily presses and holds the fabric for exactly catching and cutting off the thread chain 119, and may be optionally provided.

Thus, this embodiment in accordance with this invention is applicable to the overedge sewing machine equipped with the endless conveyer belt, and the control of the tension releasing device is performed by a control device using a conventional stitch counter, and other parts can be controlled by a non-arcing relay circuit. As a matter of course, a logic control circuit comprising integrated circuits is also available in place of said control circuit.

Figure 19:
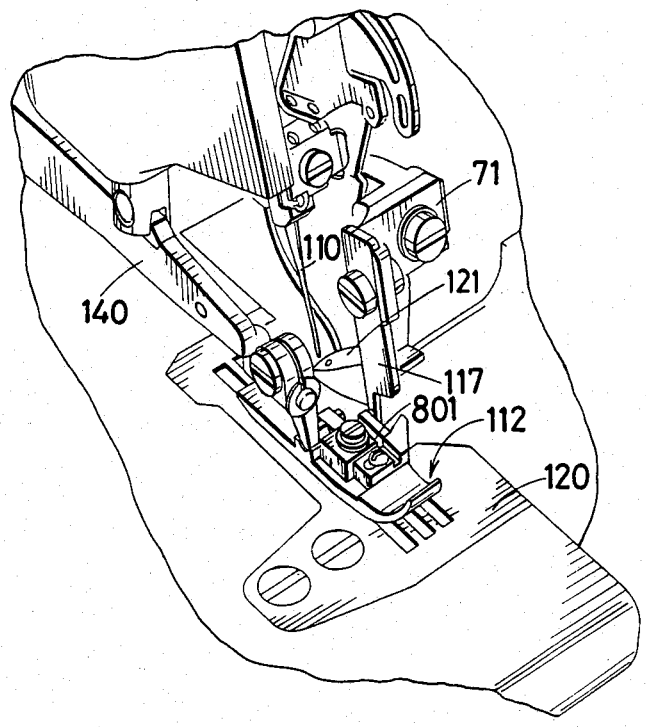
FIG. 19 is a view illustrating in detail the presser foot of FIG. 15.
Figure 22:
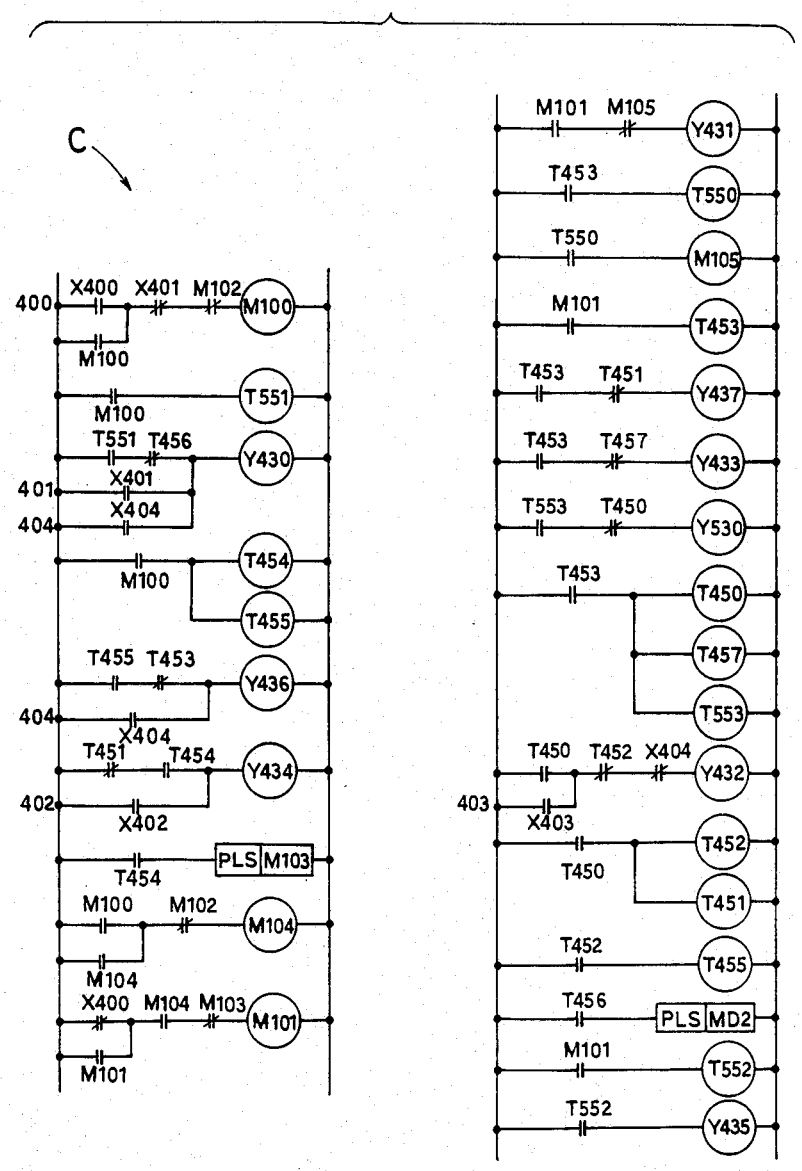
FIG. 22 is a schematic relay ladder diagram showing operation of the micro-sequencer used in the apparatus embodying this invention.
Figure 23:
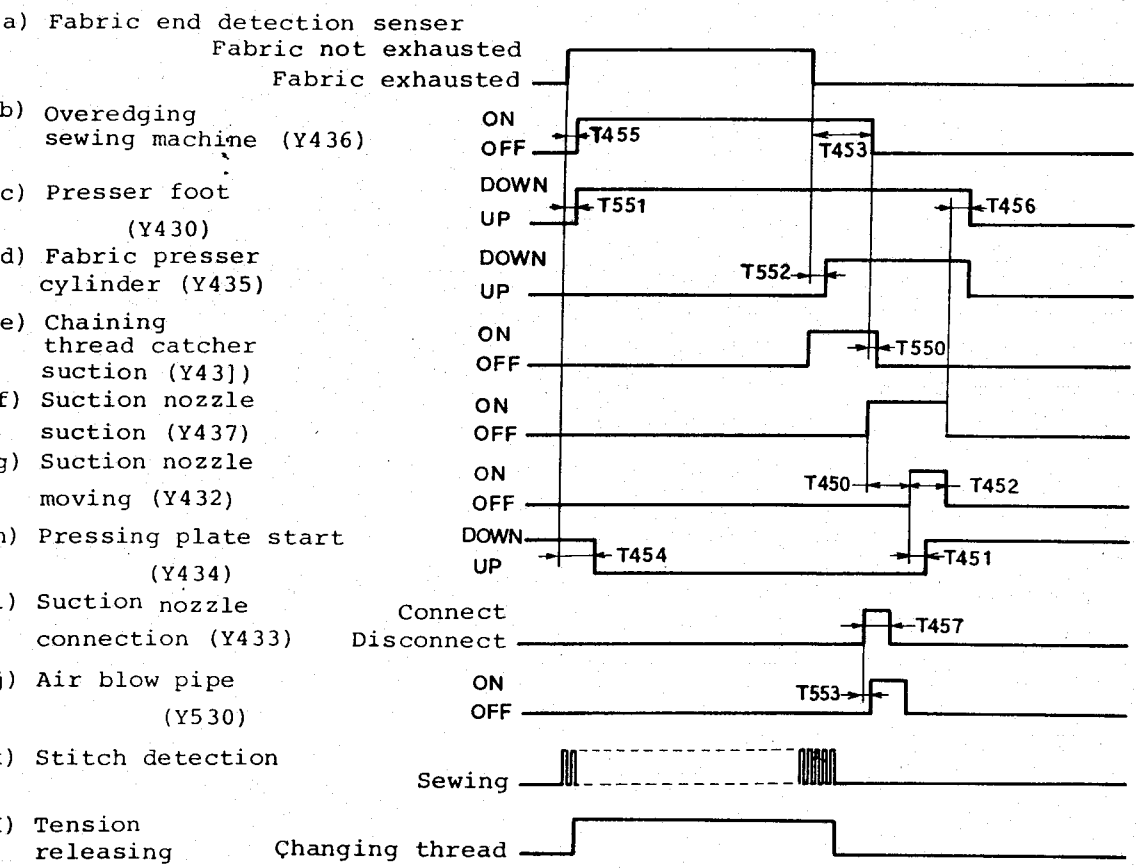
FIG. 23 is a timing chart of each part of the apparatus when carrying out the back tuck.

Referring now to FIG. 22 illustrating logical operation of a micro-sequencer forming the controller employed in the embodiment of FIG. 21 and also to FIG. 23, (a) to (i) illustrating a timing chart of the operating procedure of the apparatus embodying this invention, the operating procedure of the apparatus applied to the overedge sewing machine is now describe in detail hereunder referring to FIGS. 15, 19 and 22.

When the fabric is not inserted or set in, the presser foot 112 is situated at the lifted position and the belt 600 is also lifted at the predetermined position by the working lever connected with the presser foot 112. When the fabric is carried to the fabric setting position under the endless belt 600 by the manual operation of the operator or by such a roller, belt or the like connected with the apparatus, the end of the fabric is detected by a fabric end detection senser 613, and the controllers of the tension releasing device, as well as the micro-sequencer C for controlling the other driving parts, come into operation.

When a signal is transmitted or input to the micro-sequencer C, after passing the time respect to a timer T551, an electromagnetic valve Y430 is urged, the presser foot 112 comes down, the working lever 609 turns clockwise, and the fabric is pressed down from above by the presser foot 112 and the belt 600.

Then after passing the time preset to the timer 455, a switch Y436 is turned ON and the fabric is fed by the feed dog (not illustrated) and the belt 600 to start sewing. At this moment the working rod 403*a* of the air cylinder 403 is extended, and the thread chain pressing plate 401 is inserted into the groove 801 provided on the upper side of the presser foot 112 to press and hold the presser foot 112.

An electromagnetic valve Y434 to start the air cylinder 403 is then urged by the detection signal from the sensor 613 after passing the time preset to the timer T454, the working rod 403*a* of the air cylinder 403 is withdrawn, and the thread chain pressing plate 401 is lifted. When the detection signal from the sensor 613 is transmitted to the tension releasing device 115 and after the stitch number corresponding to the desired chain length is counted by the control device reaching to the preset count number, the signal is output, a solenoid (not illustrated) of the tension releasing device 115 is operated to change the needle thread and the looper thread tensions from "Chaining thread" to "Sewing".

When the sewing of the fabric has been completed, the terminal end of the fabric is detected by the sensor 613 and the detection signal is generated or produced. Then, the controller of the tension releasing device counts the preset stitch number, and after completing such count, the signal is output, the solenoid of the tension releasing device is actuated to change from "Sewing" to "Chaining thread" so that the fine thread chain 119 is consecutively formed from the end of the fabric.

The signal from the sensor 613 is input to the microsequencer C, and the suction at the opening 101 of the thread chain catcher 111 is started. After passing the preset time of the timer T552, the electromagnetic valve Y435 controlling the the operation of the fabric presser cylinder 614 is urged so that the working rod 614*a* thereof is extended to press the sewn fabric onto the throat plate 120. Then after passing the preset time of the timer T453, a switch Y436 is turned ON to start the sewing machine B, the needle 110 coming up from the bottom dead center moves higher above the the throat plate 120, and when the upper looper 121 is alongside the needle 110, a zero bite needle location control device is operated to stop the upper looper 121. Thus, the electromagnetic valve Y437 controlling the suction nozzle 301 is urged, the suction by the nozzle 301 is started, and the thread chain 119 is cut off by the cutter 101*a* on the suction opening 101 of the thread chain catcher 111 (FIG. 18A).

Then the electromagnetic valve 433 controlling the air cylinder 305 is started, the working rod 305*a* of the air cylinder 305 is extended, the suction nozzle 301 turns counterclockwise to come near to the suction opening 101 of the thread chain catcher 111 (FIG. 18B). After stopping the operation of the sewing machine and passing the preset time of the timer T550, the suction at the catcher 111 is stopped. After passing the preset time of the timer T553, an electromagnetic valve Y530 operating the air blow pipe 116 is urged to blow out the air from the aperture 501. As above-mentioned, the thread chain 119 formed consecutively from the end of the fabric is cut off by the knife 101*a* in the suction opening of the thread chain catcher 111 to be held in the hood 104, and while keeping such holding state the thread chain 119 is suctionally induced into the aperture of the suction nozzle 301 to be transferred.

After passing the preset time of the timer T457, the working rod 305*a* of the air cylinder 305 is withdrawn, and the suction nozzle 301 turning clockwise returns to its home position.

Figure 18C:
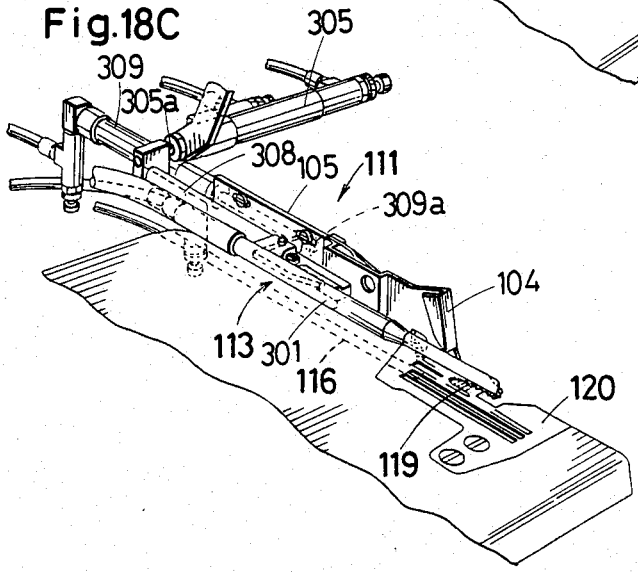

After stopping the operation of the sewing machine B and passing the preset time of the timer T450, the electromagnetic valve Y530 controlling the air blow pipe 116 is operated to stop the air from blowing. Then the electromagnetic valve Y432 controlling the air cylinder 309 is started, the working rod 309*a* of the air cylinder 309 is extended, the suction nozzle 301 catching the thread chain 119 and reaching the predetermined position on the upper face of the presser foot 112 (FIG. 18C).

When the suction nozzle 301 is situated on the upper side of the presser foot 112 during the period of the preset time of the timer T452, and after passing the preset time of the timer T451, the electromagnetic valve Y434 is now started, the working rod 403*a* of the air cylinder 403 is extended, and the thread chain 119 is pressed into the guide groove 801 provided on the presser foot 112 by the thread chain pressing plate 401 (FIG. 20A, FIG. 20B).

After passing the preset time of the timer T452, the electromagnetic valve Y437 is started to stop the suction by the suction nozzle 301, and by the operation of the electromagnetic valve Y432 the working rod 309*a* of the air cylinder 309 is withdrawn and the suction nozzle 301 returns to its original position.

Then, after passing the preset time of the timer T456, the electromagnetic valves Y430 and Y435 are operated to lift the belt 600. And at the same time the working rod 614*a* of the fabric presser air cylinder 614 is withdrawn and the fabric pressing portion 615 is also lifted.

As the result of a series of sequential controls, the thread chain 119 is pressed and held into the guide groove 801 provided an the upper side of the presser foot 112 by the pressing plate 401.

In consequence, when the new fabric is inserted under the presser foot 112 as above-described, the thread chain 119 held in the guide groove 801 is sewn from upper side of the fabric in a new seam formed on the fabric.

In this manner, in accordance with this invention, the following advantages peculiar to this invention are achieved:

In the first place, since the thread chain or chaining thread is inserted in the guide groove provided on the upper face of the presser foot to be positioned and sewn rapidly in the fabric without friction with the fabric, i.e. in the favorable condition. Particularly, as the guide groove is provided on the upper face of the presser foot for positioning of the thread chain, the slit for the feed dog can be provided on the side near to the needle location to actuate the feed dog, and accordingly the end of the fabric is carried or transferred accurately and rapidly to the needle location for the accurate and rapid overedging operation resulting in the higher efficiency.

When the thread chain is carried or transferred to above the presser foot by means of the suction nozzle of the thread chain carrier, the pressing plate is lowered by the actuation of the thread chain presser mechanism so that the thread chain is inserted in the guide groove to be positioned, thereby the positioning of the thread chain being exactly performed.

Furthermore, since the operator can watch the manner how the thread chain is held and sewn in, the necessary adjustment in positioning the thread chain can be easily carried out while watching it, i.e. before the operator's eyes. Consequently, there is no possibility of skipping a stitch when the thread chain is sewn in, since the seam can be formed from the first stitch of the sewing machine.

It will be evident to those skilled in the art that this invention is not limited to the details of the foregoing embodiments, and that this invention may be embodied in other specific forms without departing from the essential attributes thereof, and it is therefore desired that the foregoing embodiments be considered in all respects as illustrative and not restrictive, reference being made to the appended claims, rather than to the foregoing description, and all changes which come with the meaning and range of equivalency of the claims are therefore intended to be embraced therein.

What is claimed is:

1. A thread chain sewing apparatus for use in an overedge sewing machine which is equipped with a known thread chain catcher having a cutter for cutting off a thread chain formed to extend from an end of a fabric and suctionally induced to a suction opening, said thread chain sewing apparatus comprising:

a presser foot having a guide groove for insertion of a thread chain and the presser foot being movable up and down;

a thread chain carrier arranged in parallel with said thread chain catcher and having a suction nozzle for suctionally receiving the cut-off thread chain to carry the thread chain over said presser foot; and, a thread chain presser mechanism having a holding plate movable up and down above said presser foot for pressing the thread chain carried by said thread chain carrier into the guide groove of said presser foot.

2. A thread chain sewing apparatus for use in an overedge sewing machine which is equipped with a known thread chain catcher having a cutter for cutting off a thread chain formed to extend from an end of a fabric and suctionally induced to a suction opening, said thread chain sewing apparatus comprising:

a presser foot on which a guide groove is provided for insertion of the thread chain and the presser foot being movable up and down;

an air blow pipe provided under a throat plate and blowing out a charge of compressed air while orienting a blowing aperture thereof to the suction opening of said thread chain catcher;

a thread chain carrier arranged in parallel with said thread chain catcher and having a suction nozzle for suctionally receiving the cut-off thread chain to carry the thread chain over said presser foot; and, a thread chain presser mechanism having a pressing plate movable up and down above said presser foot for inserting the thread chain carried by said thread chain carrier into the guide groove of said presser foot.

3. A thread chain sewing apparatus as claimed in claim 1, wherein the presser foot is equipped with a guide latch for preventing the thread chain from escaping from the guide groove.

4. A thread chain sewing apparatus as claimed in claim 1 or 3, wherein the thread chain carrier comprises a connecting bracket connected with a working rod of an air cylinder, a holder to which the suction nozzle is fixed, said holder being connected with said connecting bracket such that the suction nozzle is urged to rotate toward a direction for separating the suction nozzle from the suction opening of the thread chain catcher, and an inclined cam for pressing the suction nozzle against the cutter in the area of the suction opening of the thread chain catcher while remaining in engagement with said holder.

5. A thread chain sewing apparatus as claimed in claim 1, 3, or 4, wherein the thread chain presser mechanism comprises a working cylinder including a spring to hold said holding plate, and an air cylinder connected with a working rod provided on one end thereof.

6. A thread chain sewing apparatus as claimed in claim 5, wherein the working cylinder is provided with an adjusting screw for adjusting an urging force of the spring.

7. A thread chain sewing apparatus as claimed in claim 1 or 3, wherein the chain presser mechanism further comprises an air cylinder connected with a working rod provided on one end thereof, and an air feed pipe, the air feed pipe being equipped with a known type air pressure regulator.

8. A thread chain sewing apparatus as claimed in claim 1 or 3, wherein the overedge sewing machine comprises a feed dog mechanism and an endless conveyer belt mechanism for feeding the fabric.

9. A thread chain sewing apparatus as claimed in claim 2, wherein the presser foot is equipped with a guide latch for preventing the thread chain inserted in the guide groove from escaping from the guide groove.

10. A thread chain sewing apparatus as claimed in claim 2 or 9, wherein the thread chain carrier comprises a connecting bracket connected with a working rod of an air cylinder, a fitting to which the suction nozzle is secured and said fitting being rotatably connected with said connecting bracket, a guide bar fixed to said fitting, a separate cylinder intersecting with the air cylinder of said connecting bracket, and a movable member fixed to a working rod of said separate air cylinder and provided with a through hole for displaceably supporting said guide bar in two directions such that the suction nozzle receives suctionally the cut-off thread chain and carries the thread chain over the presser foot.

11. A thread chain sewing apparatus as claimed in claim 2 or 9, wherein the thread chain presser mechanism comprises a pressing plate, a working cylinder including a spring to hold said pressing plate, and an air cylinder connected with a working rod provided on one end thereof.

12. A thread chain sewing apparatus as claimed in claim 11, wherein the working cylinder is provided with an adjusting screw for adjusting an urging force of the spring.

13. A thread chain sewing apparatus as claimed in claim 2 or 10, wherein the thread chain presser mechanism comprises the pressing plate, an air cylinder connected with a working rod provided on one end thereof, and an air feed pipe of the air cylinder equipped with a well-known type air pressure regulator.

14. A thread chain sewing apparatus as claimed in claims 2 or 9, wherein the overedge sawing machine comprises a feed dog mechanism and an endless conveyer belt mechanism for feeding the fabric.

15. A thread chain sewing apparatus for use in an overedge sewing machine equipped with a known-type thread chain catcher having a cutter for cutting off a thread chain formed to extend from an end of a fabric and suctionally induced to a suction opening, said thread chain sewing apparatus comprising:

a presser foot having a guide groove for insertion of the thread chain, the presser foot being movable up and down;

a thread chain carrier arranged to move between a thread chain receiving position and a thread chain transfer position and having a suction nozzle for suctionally receiving the cut-off thread chain to carry the thread chain over said guide groove; and, a thread chain presser mechanism having a pressing plate movable up and down above said presser foot for inserting the thread chain carried by said thread chain carrier into the guide groove above said presser foot, and the thread chain sewing apparatus keeping the cut-off chain in the guide groove of said presser foot.

* * * * *